US010253966B1

(12) United States Patent
Hanington et al.

(10) Patent No.: US 10,253,966 B1
(45) Date of Patent: Apr. 9, 2019

(54) LED LIGHT FIXTURE WITH HEAT SINK THERMAL BOSS

(71) Applicant: ALUMINIS LLC, Elko, NV (US)

(72) Inventors: Glen Hanington, Elko, NV (US); James Grady, Elko, NV (US)

(73) Assignee: Aluminis, LLC, Elko, NV (US)

( * ) Notice: Subject to any disclaimer, the term of this patent is extended or adjusted under 35 U.S.C. 154(b) by 0 days.

(21) Appl. No.: 15/803,153

(22) Filed: Nov. 3, 2017

(51) Int. Cl.
*F21S 4/00* (2016.01)
*F21V 29/74* (2015.01)
*F21K 9/23* (2016.01)

(52) U.S. Cl.
CPC ..... *F21V 29/745* (2015.01); *F21K 9/23* (2016.08)

(58) Field of Classification Search
CPC ..... F21V 29/763; F21V 15/01; F21V 3/00; F21V 21/047; F21V 23/006; F21V 23/008; F21V 29/717; F21V 29/83; F21V 29/89; F21V 31/005; F21V 9/20; F21V 9/40
USPC ..... 362/249, 249.02
See application file for complete search history.

(56) References Cited

U.S. PATENT DOCUMENTS 9,961,731 B2 * 5/2018 Reed ..... F21V 9/20
2013/0003313 A1 * 1/2013 Stella ..... H01L 23/3672 361/719
2015/0092416 A1 * 4/2015 Potucek ..... F21V 23/006 362/267
2015/0369466 A1 * 12/2015 Rambusch ..... F21V 29/89 362/249.02
2016/0234899 A1 * 8/2016 Reed ..... H05B 33/0827
2017/0164439 A1 * 6/2017 Reed ..... F21V 9/40

OTHER PUBLICATIONS

Phoenix Products Company, Inc., Durability X Design, ModCom 2 Series Dimensions and Specification Sheet; http://www.phoenixlighting.com/products/modcomr-2-heavy-duty-led-floodlight, downloaded Jan. 9, 2018.

* cited by examiner

*Primary Examiner* — Thien M Le
(74) *Attorney, Agent, or Firm* — Larson & Larson, P.A.; Justin P. Miller; Frank Liebenow

(57) ABSTRACT

The LED construction of the invention simplifies the thermal path for heat by directly connecting the LED and the heatsink, removing the circuit board from the thermal path. This is accomplished by a heatsink boss that protrudes from the heat sink, through an opening in the circuit board, and contacting the LED.

18 Claims, 14 Drawing Sheets

LED LIGHT FIXTURE WITH HEAT SINK THERMAL BOSS

FIELD

This invention relates to the field of LED lighting and more particularly to an LED light fixture with an improved thermal conduit between the LED and heatsink, thus improving heat dissipation.

BACKGROUND

LEDs, or light emitting diodes, are eroding the market for conventional light bulbs. From flashlights, to automobile lights and home lighting, LEDs are replacing old bulb technology.

The reason for switching to LEDs is efficiency. LEDs convert electrical energy to light with less wasted power as compared to older technologies, but do so using a very different structure. Rather than a filament that heats and produces light, each LED is a semiconductor. Because LEDs are semiconductors, LEDs are heat-sensitive. The result is an operating temperature much lower than conventional bulbs, and thus heat dissipation becomes a concern.

A conventional bulb may operate at hundreds of degrees Celsius, where an LED cannot operate above eighty degrees, or sometimes sixty degrees, Celsius. Operating at higher temperatures shortens the expected lifetime of an LED.

While LEDs are efficient, the quantity of waste heat produced increases as the LED light output grows. Heat dissipation is a minor issue in small LEDs, as the light output is low and the heat easily dissipated. But for large light outputs, using two or more high-output LEDs, the heat buildup becomes a problem.

What is needed is a light fixture with a more efficient thermal conduit between an LED heat source and a heatsink

SUMMARY

The LED construction of the invention simplifies the thermal path for heat by directly connecting the LED and the heatsink, removing the circuit board from the thermal path. This is accomplished by a heatsink boss that protrudes from the heat sink, through an opening in the circuit board, and contacting the LED.

Preventing an LED fixture from rising above its operating temperature requires creating sufficient heat transfer away from the LED. Heat transfer takes the forms of conduction, convection, and radiation.

Conduction is the movement of heat through matter without motion of the matter—ignoring the small-scale motion that occurs on a molecular level. Conduction is the movement of heat from a warmer area to a cooler area.

Convection is heat transfer created by a flowing fluid, where warmer fluid is less dense and rises, drawing in fluid behind itself.

Radiation is heat transfer by light. For the purposes of this patent application, heat loss in the form of radiation is ignored.

To understand the thermal path, or the route that heat will follow within an LED light fixture, it is helpful to understand the structure of a conventionally-structured LED.

A conventional LED, working from the top down, includes the following elements, in order:

- LED—the source of light;
  - The LED itself is a combination of multiple parts;
  - Light is generated by the LED diode chip;
  - A lens sits atop the LED diode chip, acting as a first means of controlling the path of the created light;
  - Beneath the LED diode chip is a layer of material that supports the electrical traces that connect the LED diode to power;
  - Within this document, this combination of layers is referred to generally as an LED;
- Solder point—connects the LED to the circuit board;
- Circuit board—the underlying structure to which the electronic components are mounted;
- Thermal compound—no two surfaces are perfectly flat, thus when two surfaces are placed against each other there are gaps. Thermal compound, whether a thermal paste, a thermal epoxy, or a thermal pad, fills the gaps to remove insulating air and aid thermal conductivity; and
- Heatsink—an object with a high surface area, and thus significant surface area to transfer heat from itself to the surrounding air.

Optionally, the circuit board, solder point, and junction are encapsulated, or surrounded by a protective layer.

The construction of a conventional LED fixture is acceptable in uses with low lighting demand. For example, home lighting, flashlights, and so forth. But for uses where a high lumen output is required, defined as in excess of 100,000 lumens, conventionally-constructed LED fixtures cannot dissipate heat quickly enough to avoid overheating the LED.

As a result, LED light fixtures were excluded from being used where high light output is required. For example, in stadiums, construction sites, and other situations where large areas must be lit, from afar, such that those on the ground can safely work.

Conventional LED construction has two weak points that have precluded the use of LEDs in these high-output situations. The first weak point is the long thermal path between the LED junction and the heatsink, hampering the flow of heat away from the LED. The second weak point is insufficient air flow across a heatsink mounted behind an LED array.

Addressing the first issue with conventional LED construction—a long thermal path:

Every layer in the thermal path, and every junction between layers, slows the transfer of heat away from the LED junction. The result is less heat is transferred, thereby increasing the LED junction temperature.

The solution to this problem is to remove the circuit board from the thermal path. The circuit board is a required element of the LED assembly because it supports the traces that connect electrical components. Thus, one must remove the circuit board from the thermal path while still allowing the circuit board to serve as a mounting point for the LED and its circuitry. This is accomplished by removing the circuit board beneath the LED, and penetrating the circuit board with a boss extending from the heatsink.

The result is elimination of the solder joint from the LED junction to the circuit board, and elimination of a portion of the circuit board itself. The LED sits across the penetration, or hole, within the circuit board. Heat generated by the LED junction is conducted directly from the LED to the heatsink, with only thermal paste or thermal epoxy between the two materials.

The boss carries the heat directly from the LED to the heatsink, where conduction and convection carry the heat away.

Addressing the second issue with conventional LED construction—insufficient air flow:

Individual LEDs are often combined into an array to form a fixture with a higher lumen output. The LEDs are placed on a plane, generally facing the same direction. If a heatsink is used it is rear-mounted, placed behind the LED array.

The placement of multiple LEDs across the face of a heatsink creates numerous issues: the heatsink has limited space for each LED; the heatsink is limited to air flow from the sides and back, with no ability for air to pass through the portion of the heatsink on which the LEDs are mounted; with the LEDs sharing adjacent locations on the heatsink, the heat from one LED spreads, heating the adjacent LEDs; and the portions of the heatsink that serve LEDs beyond the edges only see air that is pre-heated after passing over adjacent portions of the heatsink, The solution to the problem is to spread the LEDs across the face of an open heatsink, creating air inlets between the LEDs into the heatsink.

The heat generated by each LED is conducted into the heatsink and passed to the air between the fins of the heatsink. The air between the fins is heated, creating a convection current that draws ambient air into the heatsink. Given that ambient air can be drawn into sides of the heatsink, flow is increased, and the fins near each LED see air at ambient temperature, improving the cooling performance.

The LEDs are preferably individually enclosed, but sharing a common heatsink structure. The array of LEDs appears similar to a honeycomb with each honeycomb compartment alternating between an air inlet and an LED.

By individually enclosing each LED, the quantity of trapped air is minimized. Given the small quantity of trapped air, the quantity of moisture in the air is minimized such that even if the temperature drops below the dewpoint of the contained air, there is insufficient water to form droplets on the lens or protective glass cover.

Given that the LED fixture may be placed in any orientation, the heatsink optionally includes bores that pass perpendicularly through the plane of the fins, permitting the flow of air through what would otherwise be solid fins.

Turning to the structure of the LED fixture more generally, the following are the main components:

The heatsink, formed from a combination of a multiplicity of fins that interface with the LED heatsink bridge. The fins are either short or long. The short fins are placed in the center of the heatsink to create a gap for the power cable to pass through the heatsink.

The LED heatsink bridge thermally and mechanically joins the fins to the LEDs. One surface optionally includes comb-shaped protrusions that increase the surface area between the bridge and the fins.

The LED heatsink bridge further includes troughs or depressions to surround the circuit board, as well as the bosses or protrusions for direct contact with each LED.

Optionally included are grooves that support the housing ring that surrounds each LED.

Each individual LED is formed from an LED junction, surrounded by a protective ring. The ring surrounds the LED optics, which may constitute a reflector and/or lens. Above the optics is a protective surface, optionally formed of glass, that shields the components from the environment.

In some embodiments, the optics are Total Internal Reflection (TIR) optics formed from a refractive lens inside a reflector. TIR optics are generally superior to more conventional reflectors and lenses used with filament-based bulbs because TIR optics can sit directly on top of the LED, allowing for precise control of the generated light.

A faceplate provides mechanical protection for the LEDs, as well as thermally joining the LEDs to provide an additional avenue for the passage of heat.

In secondary embodiments, the bezels that form part of the faceplate are removable to allow the LEDs to be serviced.

By thermally connecting the components of the fixture, heat is dissipated across the fixture for maximum dissipation.

Example thermal paths include: LED to LED heatsink bridge to fins; heatsink fins to faceplate; and LED to LED heatsink bridge to LED rings to faceplate.

An LED driver is optionally included to power the LEDs. The driver is preferably located at the back of the fixture behind a removable faceplate.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
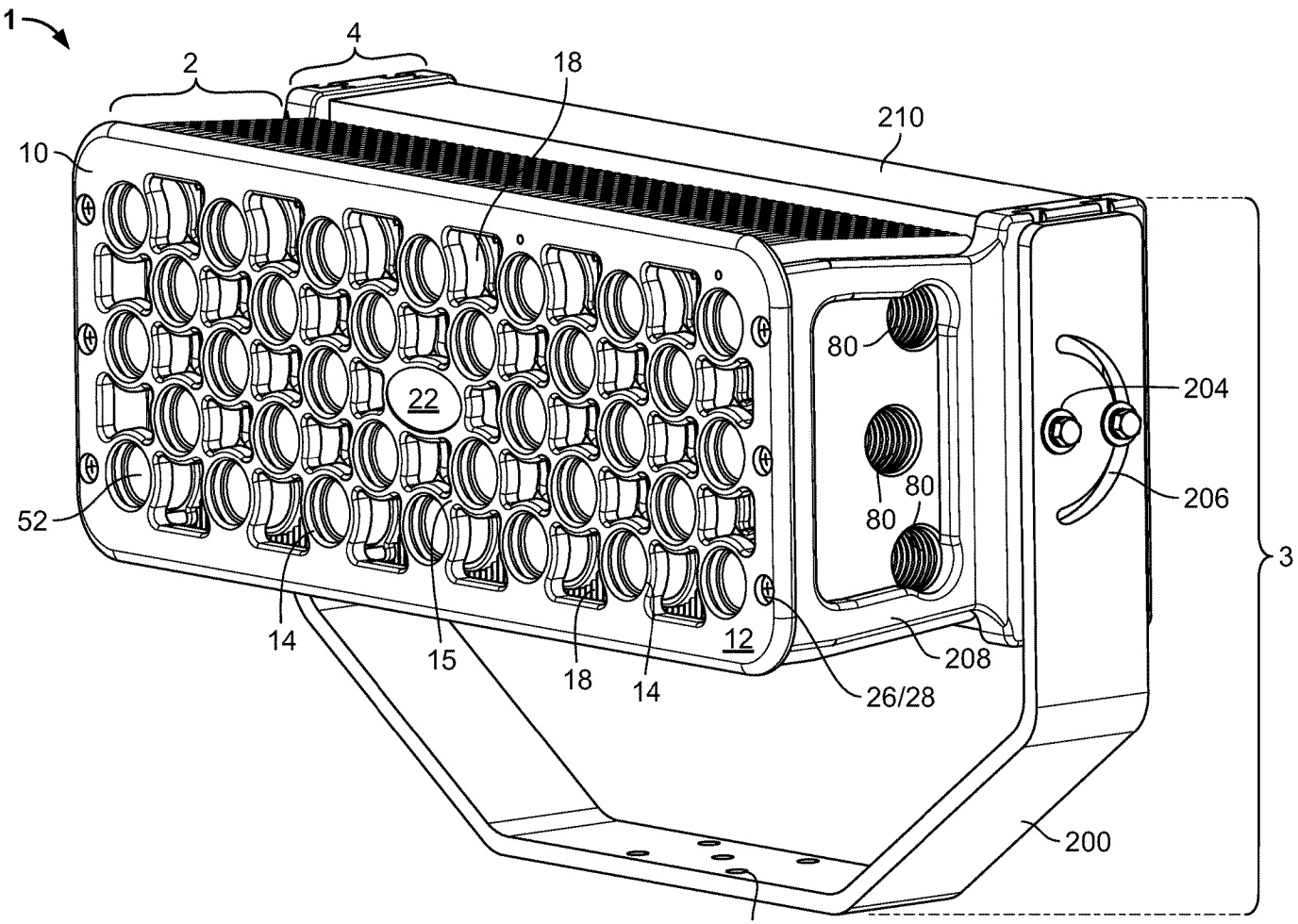
FIG. 1 illustrates an isometric view of a first embodiment of the front of the LED light fixture.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an isometric view of a first embodiment of the front of LED light fixture is shown.

The flow-through LED light fixture 1 is formed from three primary sections—the lighting unit 2, which includes the LEDs and heatsink, the support structure 3, which includes the mounting bracket 200 and bridge bracket 208, and the power delivery unit 4, which includes the driver compartment 210 and associated parts.

The lighting unit 2 includes a faceplate 10 formed from numerous LED bezels 14, connected to adjacent LED bezels 14 by LED bezel bridges 15. The collection of LED bezels 14 and LED bezel bridges 15 is surrounded by a perimeter 12.

An optional bridge 22 is set in the middle of the faceplate 10, covering the cable penetration through the heatsink (not shown).

Within each LED bezel 14 is a disc of protective glass 52. Between the LED bezels 14 are faceplate air inlets 18 that allow air to pass through the faceplate 10 to the heatsink 70.

Also shown are the heatsink airflow tunnels 80 to permit the flow of air through the sides of the fins.

The flow-through LED light fixture 1 optionally includes a bracket 200 with multiple bracket mounting holes 202 to affix the bracket 200 to a mounting location.

The bridge bracket 208 connects the driver compartment 210 to the faceplate 10 at mounting screw penetrations 26 with mounting screws 28. The mounting bracket 200 is connected to the bridge bracket 208 at pivot point 204, which optionally includes a pivot fastener.

An arc-shaped slot 206 is used to lock the angular position of the mounting bracket 200 with respect to the bridge bracket 208.

Figure 2:
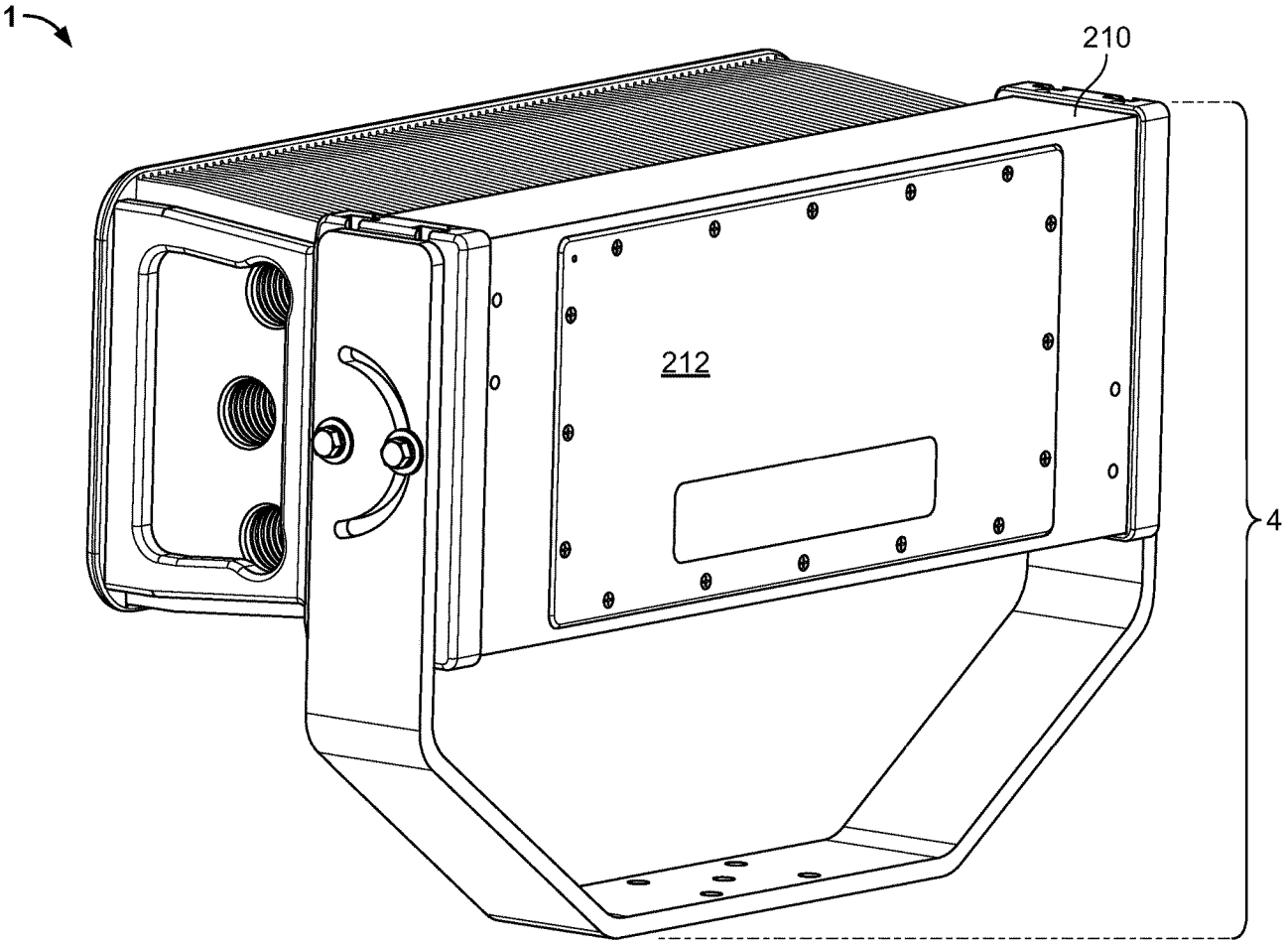
FIG. 2 illustrates an isometric view of a first embodiment of the rear of the LED light fixture.

Referring to FIG. 2, an isometric view of a first embodiment of the rear of LED light fixture is shown.

The driver compartment 210 contains the electronics required to power and control the LEDs. The driver (not shown) is accessible through the driver access door 212.

Figure 3:
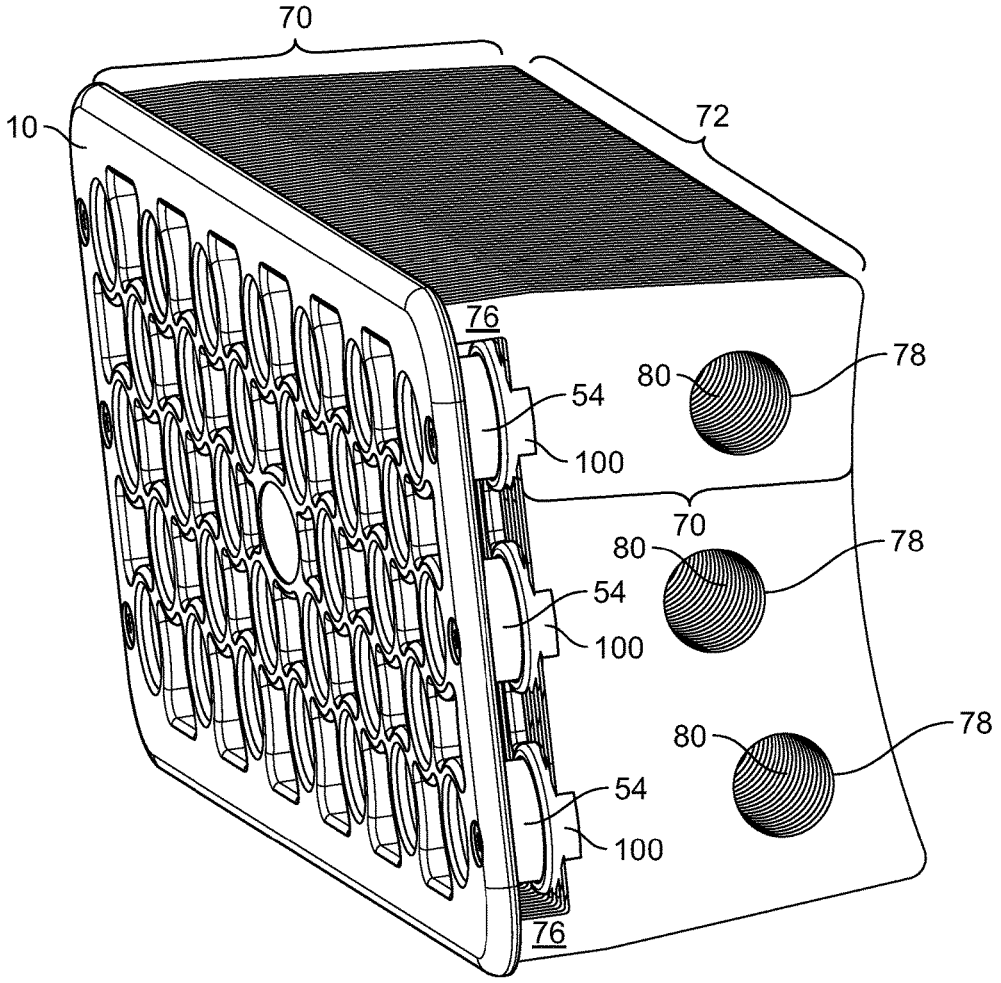
FIG. 3 illustrates an isometric view of a first embodiment of the front of the LED light fixture, without the mounting bracket.

Referring to FIG. 3, an isometric view of a first embodiment LED light fixture is shown without the mounting bracket.

The heatsink 70 is visible, formed from the combination of heatsink fins 72 and LED heatsink bridge 100. Multiple fin penetrations 78 are shown, creating heatsink airflow tunnels 80 through the heatsink fins 72, permitting airflow into the side of the heatsink 70. Each heatsink fin 72 optionally includes a fin bridge protrusion 76 that thermally connects the heatsink fin 72 to the faceplate 10.

The support rings 54 thermally and mechanically connect the LED heatsink bridge 100 to the faceplate 10. The support rings 54 further act to protect the LEDs from mechanical damage.

Figure 4:
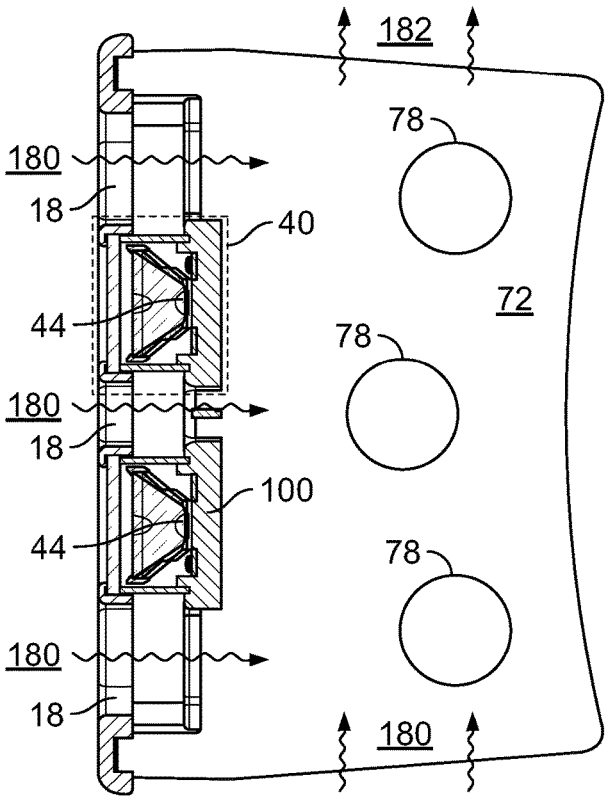
FIG. 4 illustrates a cross section of a first embodiment of the LED light fixture from top to bottom, with LEDs facing left, showing air flow from the bottom and face.

Referring to FIG. 4, a cross section is shown of a first embodiment of the LED light fixture from top to bottom, with LEDs facing left, showing air flow from the bottom and face.

This figure is used to show convection flow, thus orientation is important. The LED modules 40 are pointed left, with the warm air rising up with respect to the figure.

When the LEDs 44 are producing light, heat is correspondingly produced. The heat will flow from the LED 44 to the LED heatsink bridge 100, then to the heatsink fins 72. The air around the heatsink fins 72 will warm, and then rise. The result is a convection current. Cool incoming air 180 flows through the faceplate air inlets 18, as well as into the bottom of the heatsink fins 72, is warmed by the heatsink fins 72, and flows out the top as warm outgoing air 182.

Figure 5:
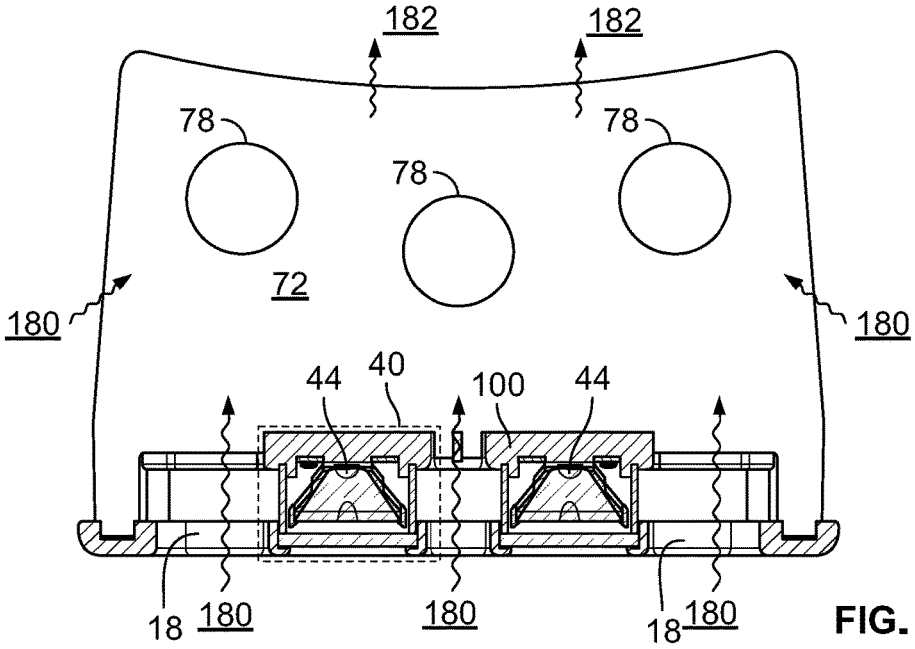
FIG. 5 illustrates a cross section of a first embodiment of the LED light fixture from top to bottom, with LEDs facing down, showing air flow from the face and sides.

Referring to FIG. 5, a cross section is shown of a first embodiment of the LED light fixture from top to bottom, with LEDs facing down, showing air flow from the face and sides.

In this figure the LED modules 40 face down, as may be used for ceiling-mounted indoor lights. In this orientation, with the LEDs generating heat, the surrounding air is heated by the heatsink fins 72 and rises. Cool incoming air 180 is drawn in through the faceplate air inlets 18, passing over the heatsink fins 72, passing out as warm outgoing air 182.

Figure 6:
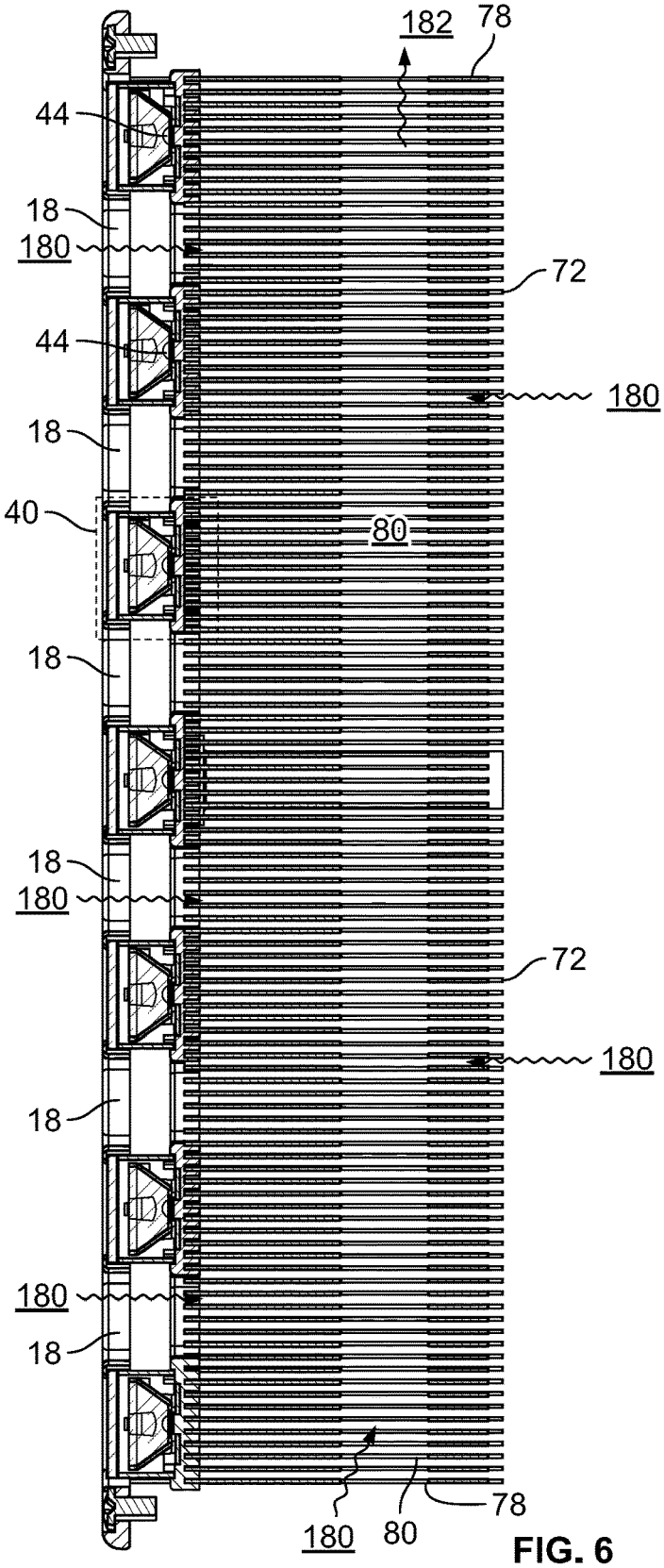
FIG. 6 illustrates a cross section of a first embodiment of the LED light fixture from left to right, with LEDs facing left, showing air flow through the fins.

Referring to FIG. 6, a cross section of a first embodiment of the LED light fixture from left to right, with LEDs facing left, showing air flow through the fins.

When the LEDs 44 are producing light, the waste heat will flow from each LED 44 to the LED heatsink bridge 100, then to the heatsink fins 72. The air around the heatsink fins 72 warms, and then rises.

The heatsink fins 72 are oriented in and out of the page, and as a result largely block any vertical flow of air through the heatsink fins 72. To address this issue, each heatsink fin 72 optionally includes a fin penetration 78, which combine to form a heatsink airflow tunnel 80.

The result is cool incoming air 180 is drawn in through the faceplate air inlets 18, passes between the heatsink fins 72, rises through the heatsink airflow tunnel 80, and exits as warm outgoing air 182.

Figure 7:
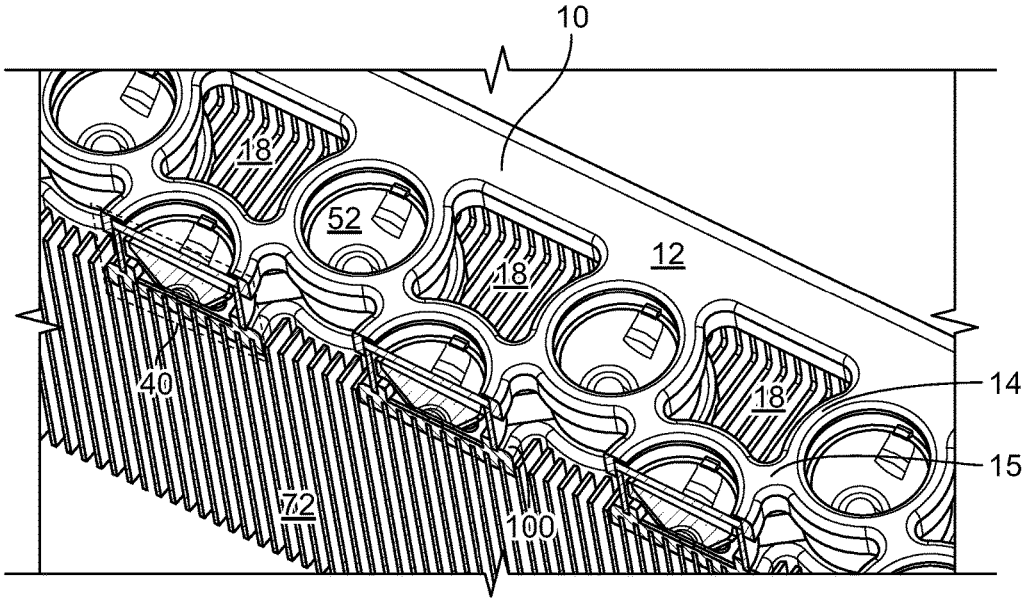
FIG. 7 illustrates an isometric cross section of the LEDs and the heatsink, further showing air inlets.

Referring to FIG. 7, an isometric cross section of the LEDs and the heatsink is shown, providing a clear view of the air inlets.

The LED bezels 14 and LED bezel bridges 15 form the center section of the faceplate 10, surrounded by the perimeter 12. A disc of protective glass 52 is held within each LED bezel 14. Between the LED bezels are faceplate air inlets 18, permitting air to flow directly into the heatsink fins 72.

Cross sections of one set of LED modules 40 are shown.

Figure 8:
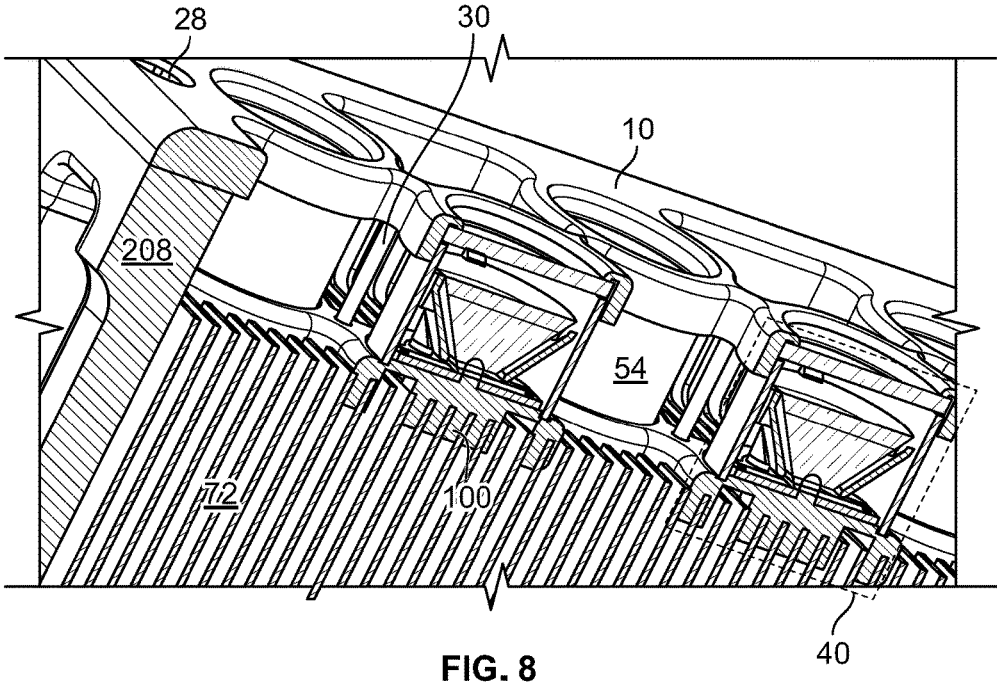
FIG. 8 illustrates an isometric cross section of the LEDs and the heatsink, further showing the rings and other parts of faceplate.

Referring to FIG. 8, an isometric cross section of the LEDs and the heatsink is shown, further showing the rings and other parts of faceplate.

The support rings 54 for each LED module 40 are shown, which in combination with optional standoffs 30, support the position of the faceplate 10 with respect to the LED heatsink bridge 100.

The bridge bracket 208 is visible, connected to the faceplate 10 by mounting screws 28.

Figure 9:
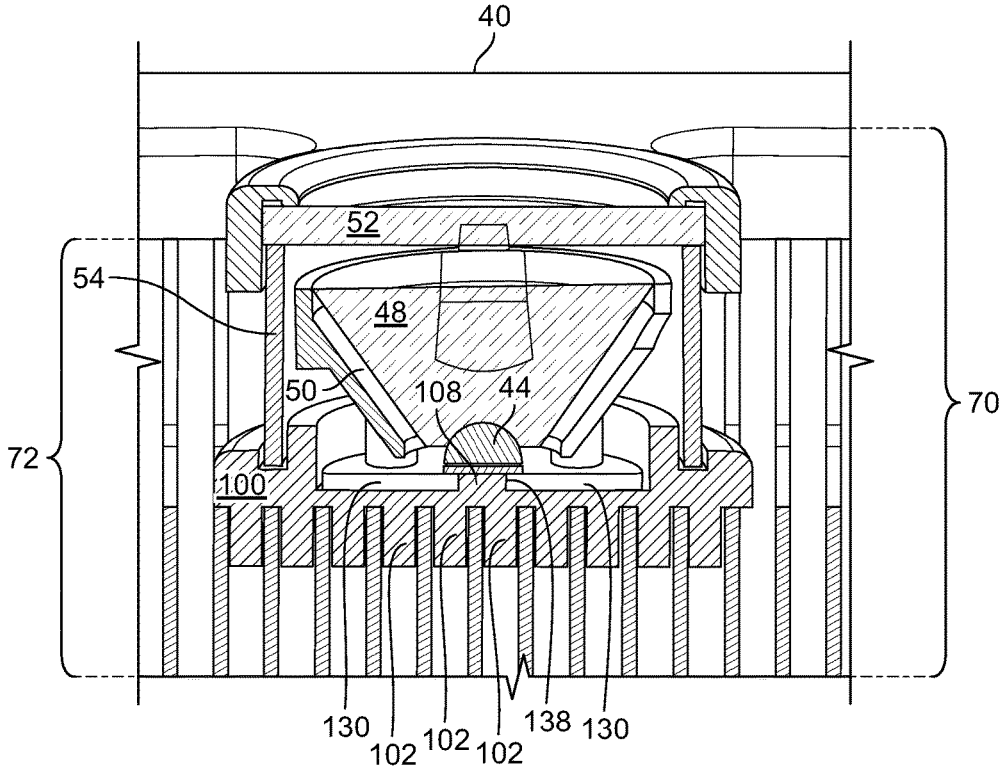
FIG. 9 illustrates a cross section of an LED assembly.

Referring to FIG. 9, a cross section of an LED module is shown.

The LED module 40 includes LED 44, with power provided by electrical connections. Moving downward with respect to the LED 44, it is supported on its edges by the LED interconnect board 130, with the LED 44 substantially thermally joined to the LED heat transfer boss 108, which carries heat to the LED heatsink bridge 100 and subsequently to the heatsink fins 72.

The LED 44 is electrically connected at the portions of its lower face supported by the LED interconnect board 130.

The LED heat transfer boss 108 negates the need to transfer heat through the LED interconnect board 130, as the boss 108 protrudes through the heat transfer penetration 138. The result is an increase in the efficiency of the heat transfer and a reduction in heat buildup within the LED 44.

Moving upward with respect to the LED 44, a lens 48 and/or reflector 50 focuses and controls the light output of the LED 44. A disc, or other shape, of protective glass 52 is held in place by a support ring 54.

Figure 10:
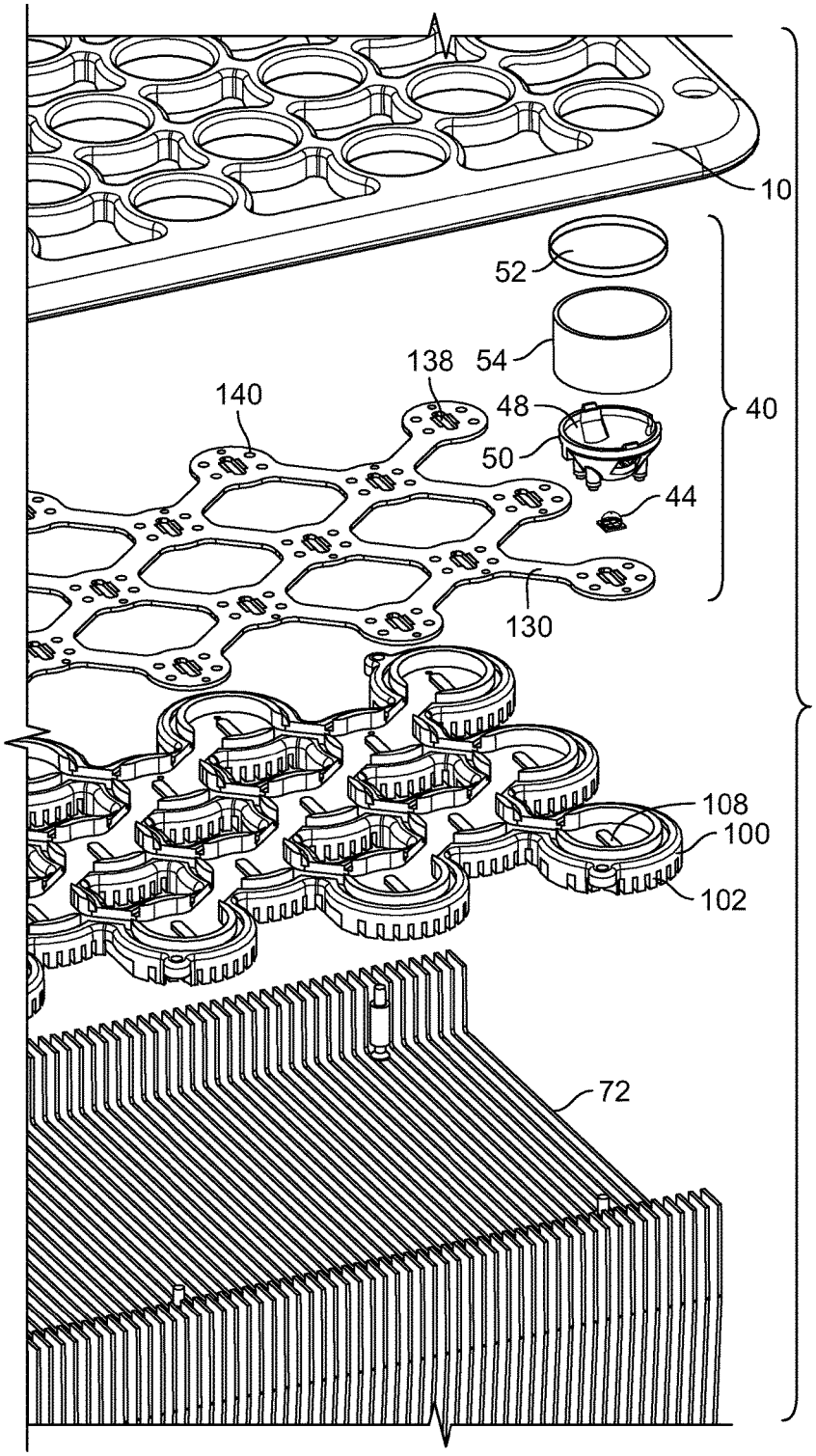
FIG. 10 illustrates a first exploded view of all parts.
Figure 11:
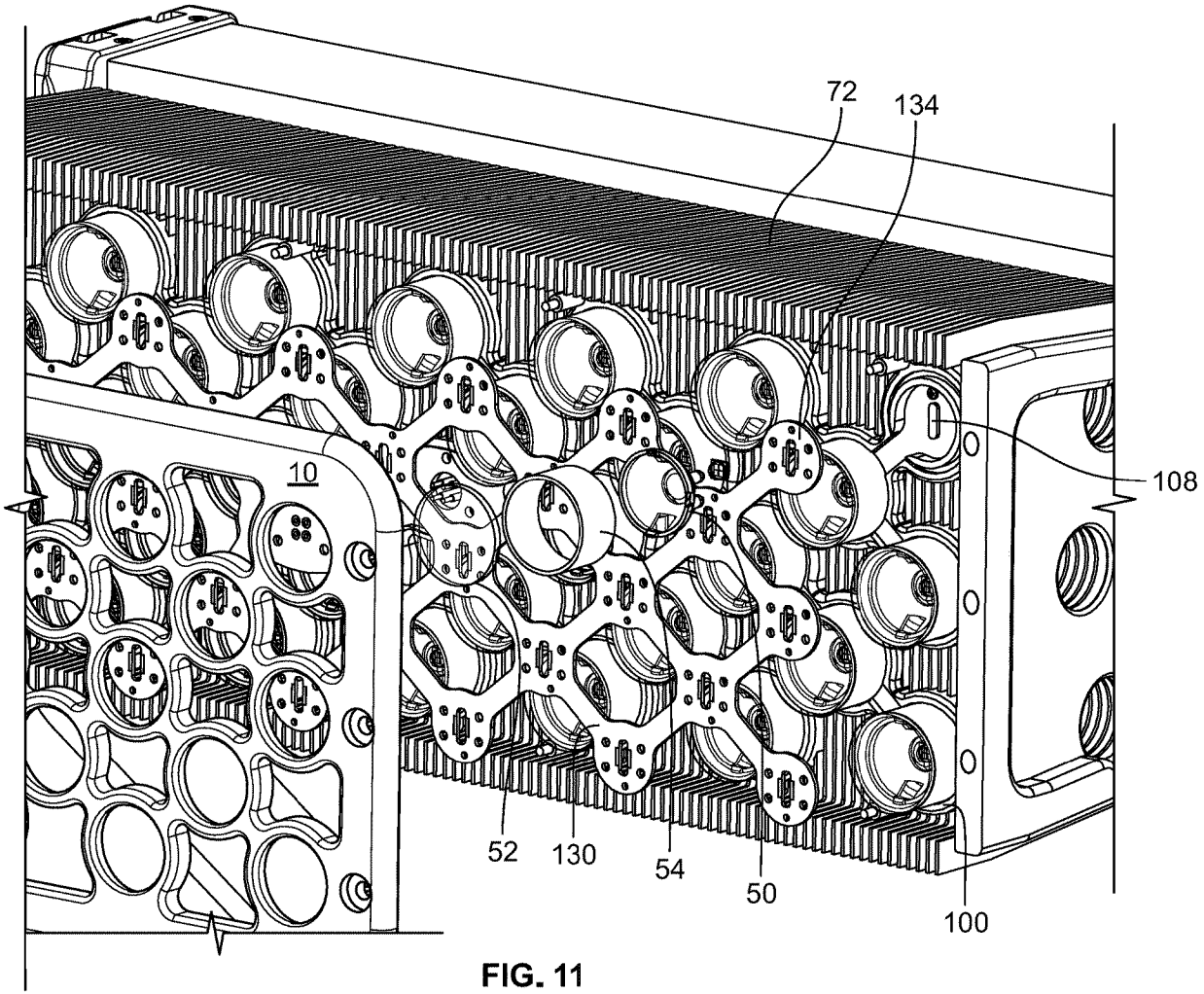
FIG. 11 illustrates a second exploded view of all parts.

Referring to FIGS. 10 and 11, an exploded view of all parts is shown.

The heatsink fins 72 connect to the LED heatsink bridge 100. The LED interconnect board 130 is partially surrounded by the LED heatsink bridge 100, with each LED heat transfer boss 108 aligning with its respective heat transfer penetration 138.

The LED module 40 is formed from the LED 44 placed on the LED heat transfer boss 108. The LED 44 is then surrounded by the lens 48 and/or reflector 50, covered by the protective glass 52 that is supported by a support ring 54.

Figure 12:
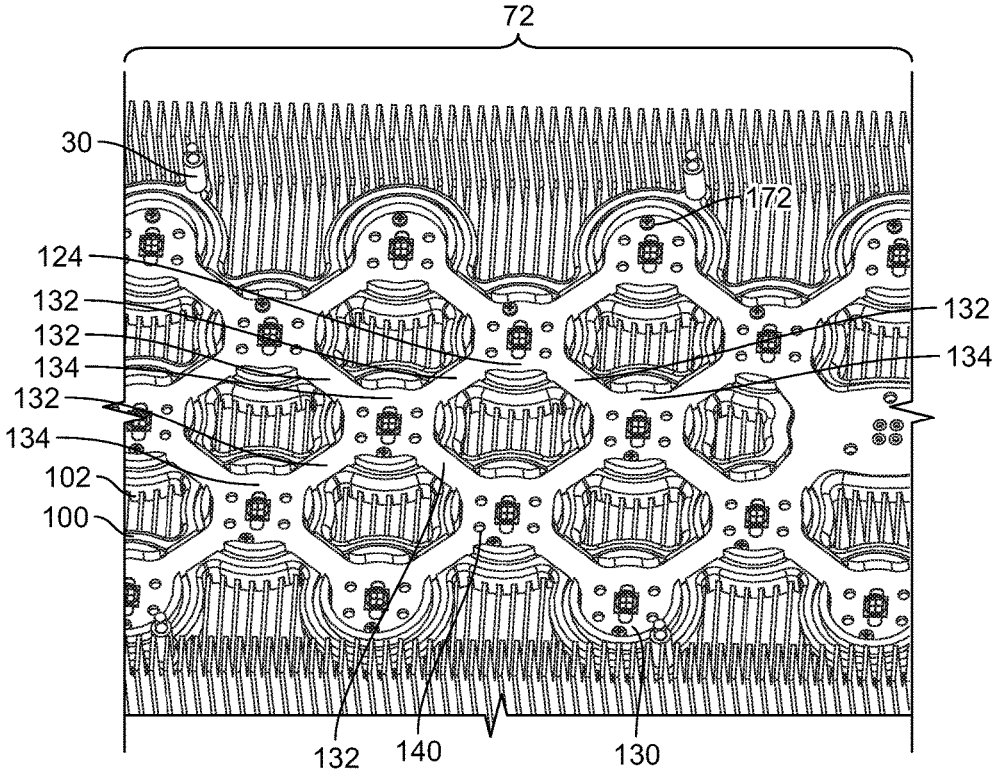
FIG. 12 illustrates an isometric view of the LED heatsink bridge and circuit board with LED, mounted on the heatsink.

Referring to FIG. 12, an isometric view of the LED heatsink bridge and circuit board with LED is shown mounted on the heatsink.

The LED heatsink bridge 100 thermally connects the heatsink fins 72 and supports the LED interconnect board 130. The LED interconnect board 130 is formed from a collection of LED board hubs 134 connected by LED board arms 132. Heat transfer penetrations 138 (not shown) permit the LED heat transfer boss 108 to contact the LED 44. Optional lens support penetrations 140 allow the lens 48 to rest against the LED interconnect board 130. One or more board hold-down fasteners 142 removably affix the LED interconnect board 130 to the LED heatsink bridge 100.

The comb-shaped protrusions 102 of the LED heatsink bridge 100 are shown between the fins 72 of the heatsink 70.

Standoffs 30 support the faceplate 10 (not shown).

Figure 13:
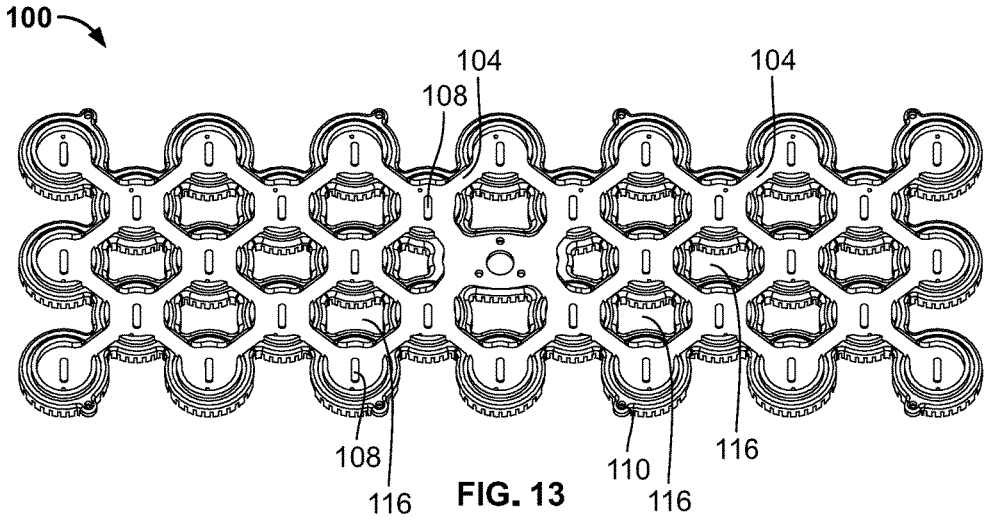
FIG. 13 illustrates an isometric view of the top of the LED heatsink bridge.
Figure 14:
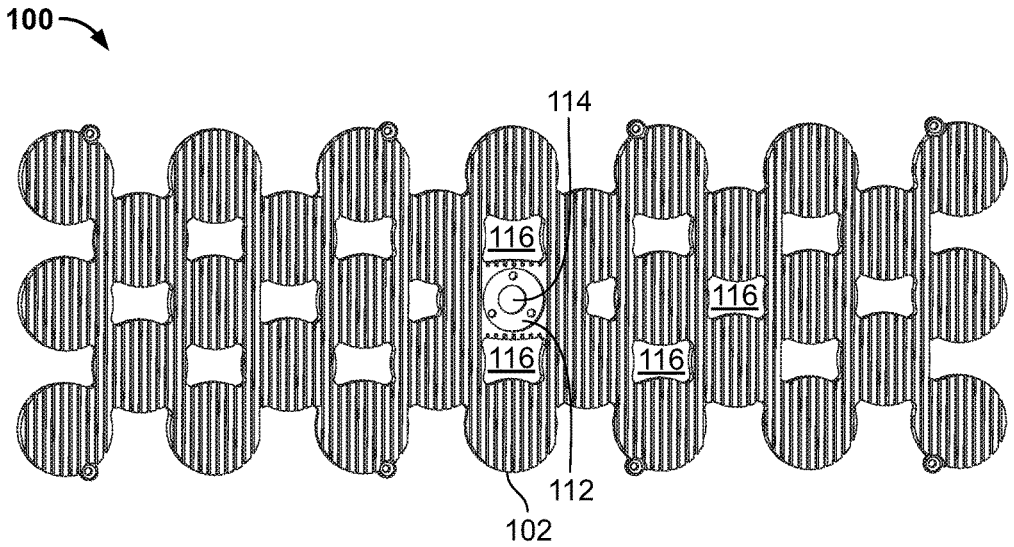
FIG. 14 illustrates an isometric view of the bottom of the LED heatsink bridge.

Referring to FIGS. 13 and 14, isometric views of the top and bottom of the LED heatsink bridge are shown.

Multiple heatsink bridge air inlets 116 allow air to pass through the LED heatsink bridge 100. An optional circuit board inset 104 supports the LED interconnect board 130 (not shown). An optional LED ring inset 106 holds each support ring 54 (not shown) in position.

Standoff support holes 110 receive standoffs 30 (not shown) that help to support and position the faceplate 10.

On the bottom, the cable path mounting recess 112 receives the electrical cable, or its support bracket. The cable passes through the cable path penetration 114.

A multiplicity of optional comb-shaped protrusions 102 support the heatsink fins 72 (not shown), increasing the contact area and improving heat transfer.

Figure 15:
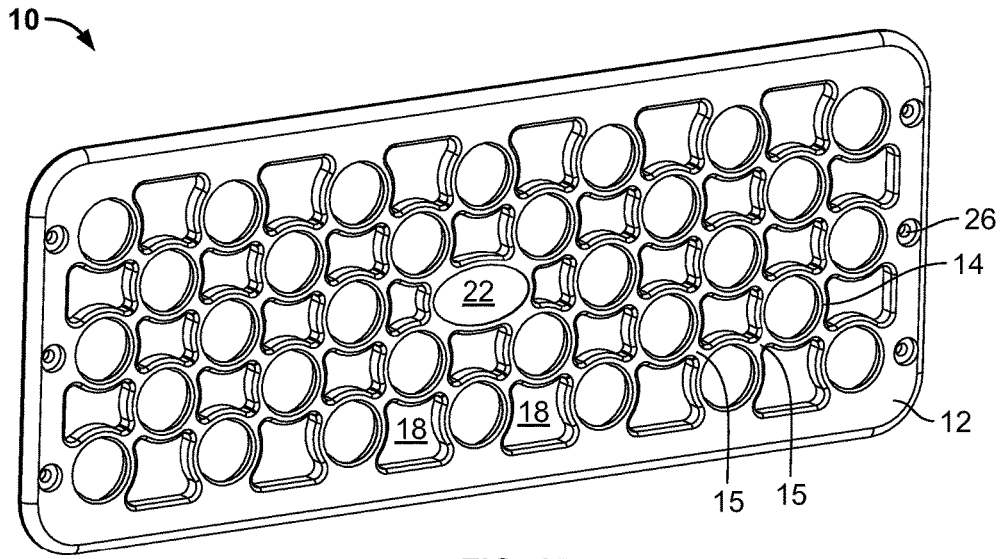
FIG. 15 illustrates an isometric view of the front of the faceplate.
Figure 16:
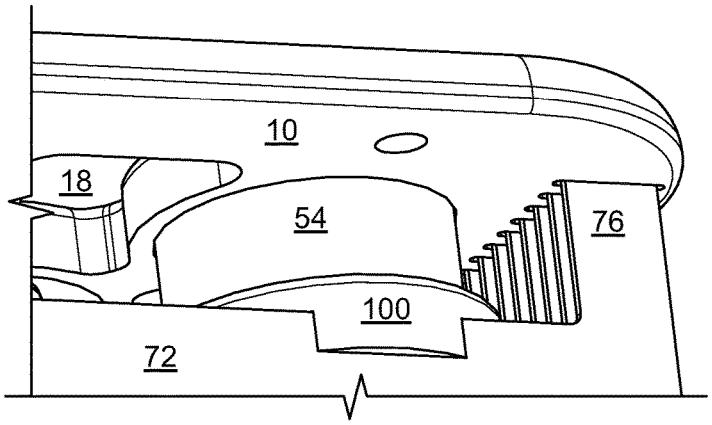
FIG. 16 illustrates an isometric view showing heatsink fins insertion point for faceplate.
Figure 17:
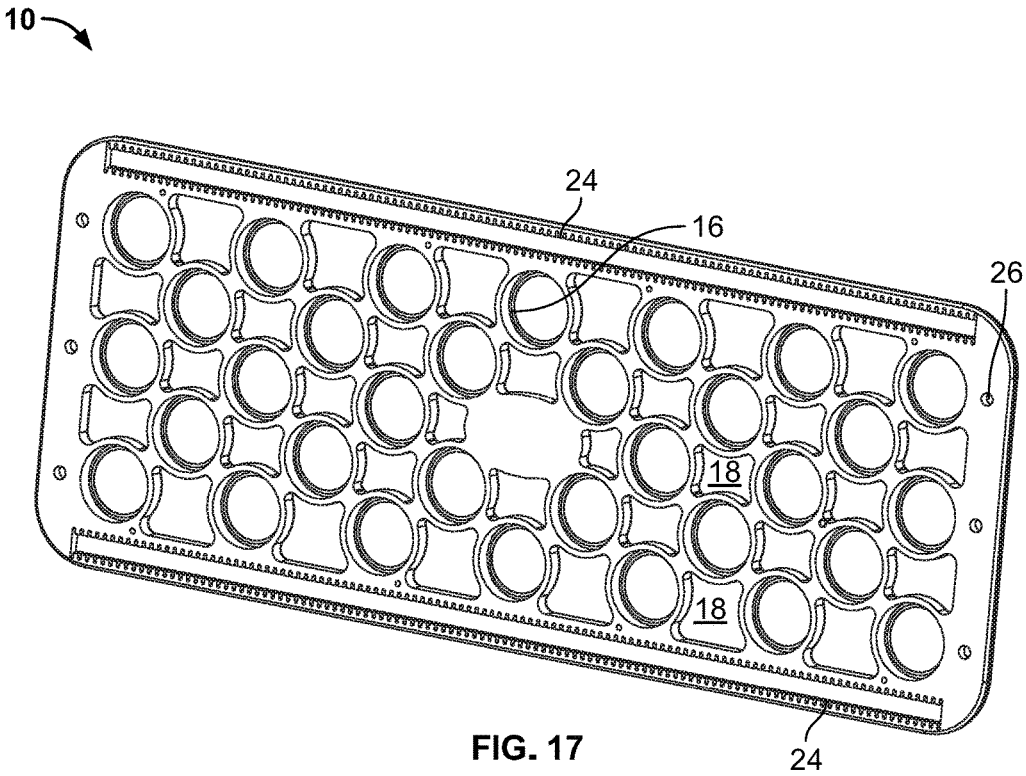
FIG. 17 illustrates an isometric view of the faceplate back, showing the heatsink fin insertion locations.

Referring to FIGS. 15 through 17, isometric views of the front and rear of the faceplate are shown.

The LED bezels 14 and LED bezel bridges 15 are shown, with faceplate air inlets 18.

The support ring 54 is connected to the faceplate 10 and LED heatsink bridge 100, carrying heat from the warmer components to the cooler components.

Fin bridge protrusions 76 penetrate the faceplate 10, sitting within heatsink fin slots 24, further bridging the components to create single thermal unit.

The faceplate 10 includes glass mounting insets 16 within each LED bezel 14 to support protective glass 52.

Figure 18:
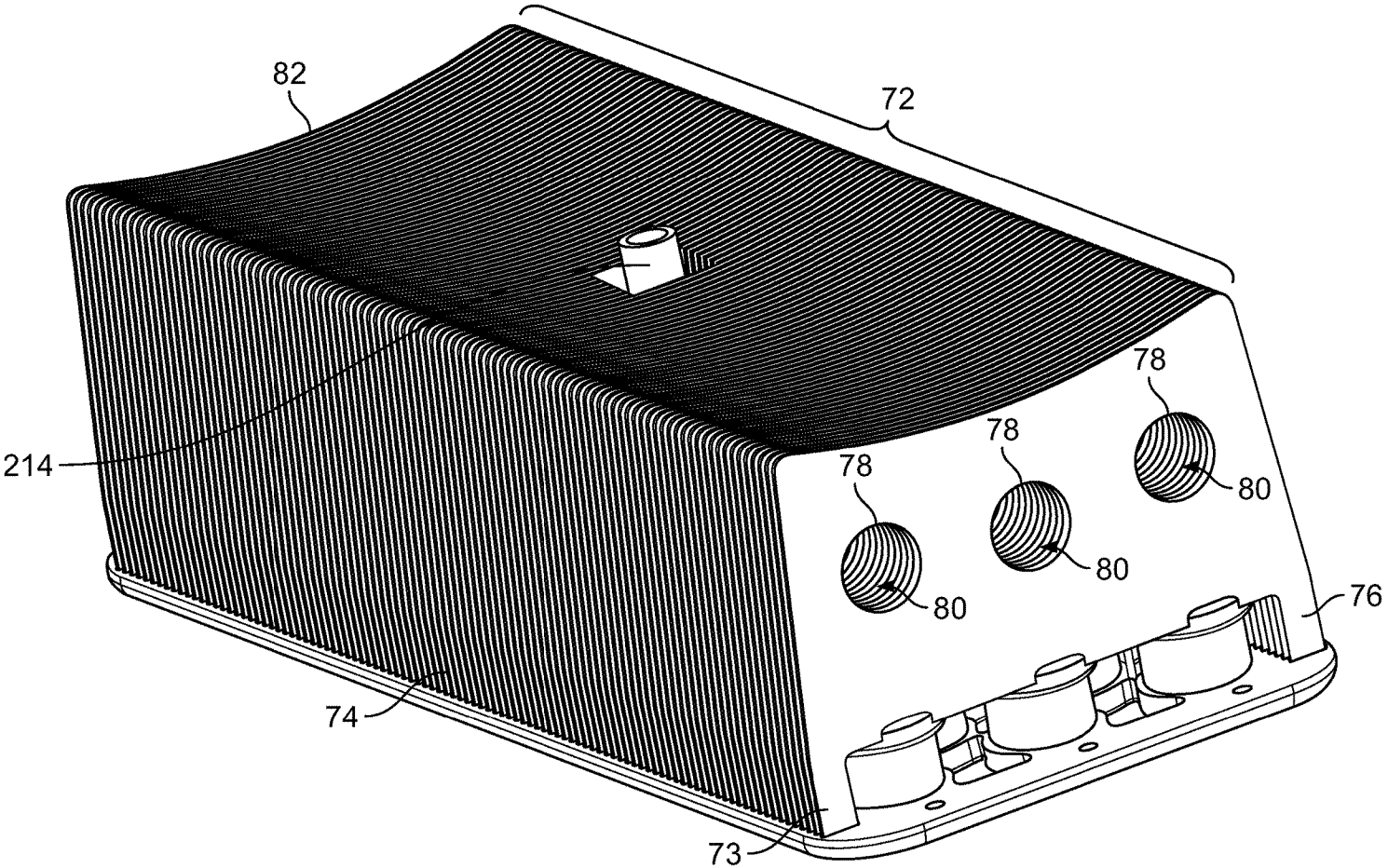
FIG. 18 illustrates an isometric view heatsink back, showing the heatsink profile and cable penetration.

Referring to FIG. 18, an isometric view of the back of the heatsink is shown, including the cable penetration.

The heatsink fins 72 are largely heatsink long fins 73, with a section of heatsink short fins 74 around the power cable shield 214.

The heatsink fins 72 optionally include a curved rear face 82. The curvature creates an additional path for air between the heatsink fins and the driver compartment 210 (not shown).

Figure 19:
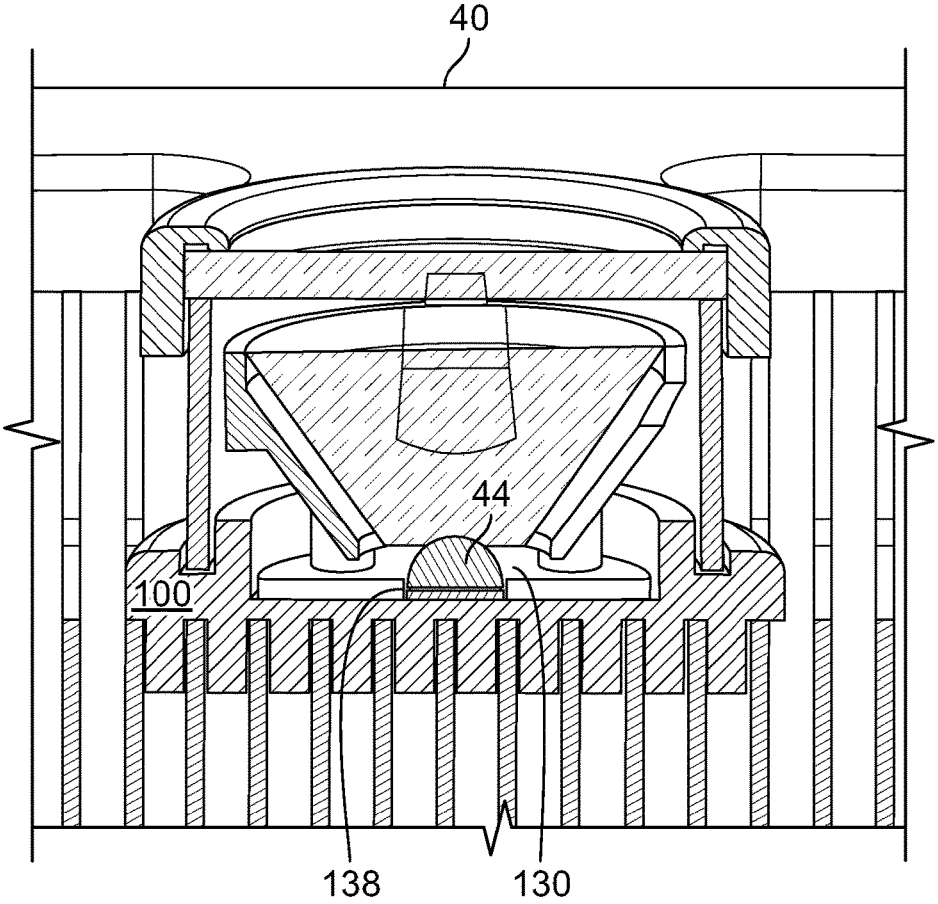
FIG. 19 illustrates an alternative embodiment for transferring heat from the LED to the heatsink.

Referring to FIG. 19, a cross section of an alternative embodiment of the LED module is shown.

The LED module 40 again includes an LED 44 supported by the LED interconnect board 130. But rather than the LED 44 resting atop a heatsink boss, the LED 44 is inset into the heat transfer penetration 138 of the interconnect board 130. No thermal boss is required, as the LED 44 carries heat directly to the LED heatsink bridge 100 and subsequently to the heatsink fins 72.

As in the preferred embodiment, a lens 48 and/or reflector 50 focuses and controls the light output of the LED 44. A disc, or other shape, of protective glass 52 is held in place by a support ring 54.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An LED light fixture that prevents LED overheating comprising:

an LED mounted over a hole in a circuit board;

a heat sink;

the heat sink including a protrusion;

the protrusion passes through the hole in the circuit board;

the protrusion thermally connected to the heatsink;

the protrusion in contact with the LED;

whereby heat generated by the LED during operation is conducted to the protrusion, which in turn conducts the heat to the heatsink.

2. The LED light fixture of claim 1, wherein the heatsink is comprised of:

a multiplicity of fins;

an LED heatsink bridge;

the circuit board between the LED and the LED heatsink bridge;

the protrusion integral to the LED heatsink bridge;

the LED heatsink bridge thermally connecting substantially every fin of the multiplicity of fins in order to spread heat across the fins.

3. The LED light fixture of claim 2, wherein the LED heatsink bridge further comprises:

comb-shaped protrusions integral to the LED heatsink bridge and located at the interface between the multiplicity of fins and the LED heatsink bridge;

the comb-shaped protrusions increasing the contact area between the LED heatsink bridge and the multiplicity of fins, thereby improving heat transfer by conduction.

4. The LED light fixture of claim 1, wherein each LED is an LED module comprised of:

an LED junction that converts electrical energy to light;

a support ring that substantially surrounds the LED junction;

a protective glass surface located adjacent to the support ring, on an opposite end as compared to the LED junction;

a reflector within the support ring that gathers and focuses the light produced by the LED junction;

wherein the LED ring captures and contains air, the air neither entering nor exiting the LED module.

5. The LED light fixture of claim 1, further comprising:
a layer of thermal compound between the LED and the boss protrusion;
whereby the thermal compound fills any gaps between a surface of the LED and a surface of the protrusion.

6. The LED light fixture of claim 1, wherein the LED is a multiplicity of LEDs, the fixture further comprising:
an LED interconnect board that electrically connects the individual LEDs;
the LED interconnect board located between the LED heatsink bridge and the individual LEDs;
each LED of the multiplicity of LEDs having an associated protrusion that protrudes through the circuit board, each associated protrusion carrying heat to the heatsink.

7. An LED light fixture with improved heat transfer comprising:
a circuit board with a hole;
an LED placed across the hole on a first side of the circuit board;
a heatsink on a second side of the circuit board;
the heatsink having a protrusion;
the protrusion thermally connecting the heatsink and LED through the circuit board.

8. The LED light fixture of claim 7, wherein the heatsink is comprised of:
a multiplicity of fins;
an LED heatsink bridge;
the circuit board between the LED and the LED heatsink bridge;
the LED heatsink bridge thermally connecting substantially every fin of the multiplicity of fins in order to efficiently spread heat across the fins.

9. The LED light fixture of claim 7, wherein the LED heatsink bridge further comprises:
comb-shaped protrusions integral to the LED heatsink bridge and located at the interface between the multiplicity of fins and the LED heatsink bridge;
the comb-shaped protrusions increasing the contact area between the LED heatsink bridge and multiplicity of fins, thereby improving heat transfer by conduction.

10. The LED light fixture of claim 7, wherein each LED is an LED module comprised of:
an LED junction that converts electrical energy to light;
a support ring that substantially surrounds the LED junction;
a protective glass surface located adjacent to the support ring, on an opposite end as compared to the LED junction;
a reflector within the support ring that gathers and focuses the light produced by the LED junction;
wherein the support ring captures and contains air, the air neither entering nor exiting the LED module.

11. The LED light fixture of claim 7, further comprising:
a layer of thermal compound between the LED and the heatsink;
whereby the thermal compound fills any gaps between a surface of the LED and a surface of a boss.

12. The LED light fixture of claim 7, wherein the LED is a multiplicity of LEDs, the fixture further comprising:
an LED interconnect board that electrically connects the individual LEDs;
the LED interconnect board located between the LED heatsink bridge and the individual LEDs.

13. An LED fixture for superior thermal cooling comprising:
a circuit board with an opening beneath an LED;
a heatsink partially extending through the opening;
whereby the heatsink contacts the LED, thermally connecting the LED to the heatsink without conducting heat through the circuit board.

14. The LED fixture of claim 13, wherein the heatsink is comprised of:
a multiplicity of fins;
an LED heatsink bridge;
the circuit board between the LED and the LED heatsink bridge;
a protrusion integral to the LED heatsink bridge, the protrusion contacting the LED;
the LED heatsink bridge thermally connecting substantially every fin of the multiplicity of fins in order to efficiently spread heat across the fins.

15. The LED fixture of claim 14, further comprising:
a layer of thermal compound between the LED and the protrusion;
whereby the thermal compound fills any gaps between a surface of the LED and a surface of the protrusion.

16. The LED fixture of claim 13, wherein the LED heatsink bridge further comprises:
comb-shaped protrusions integral to the LED heatsink bridge and located at the interface between the multiplicity of fins and the LED heatsink bridge;
the comb-shaped protrusions increasing the contact area between the LED heatsink bridge and multiplicity of fins, thereby improving heat transfer by conduction.

17. The LED fixture of claim 13, wherein each LED is an LED module comprised of:
an LED junction that converts electrical energy to light;
a support ring that substantially surrounds the LED junction;
a protective glass surface located adjacent to the support ring, on an opposite end as compared to the LED junction;
a reflector within the support ring that gathers and focuses the light produced by the LED junction;
wherein the support ring captures and contains air, the air neither entering nor exiting the LED module.

18. The LED fixture of claim 13, wherein the LED is a multiplicity of LEDs, the fixture further comprising:
an LED interconnect board that electrically connects the individual LEDs;
the LED interconnect board located between the LED heatsink bridge and the individual LEDs.

* * * * *